US005418026A

United States Patent [19]

Dronzek, Jr. et al.

[11] Patent Number: 5,418,026

[45] Date of Patent: May 23, 1995

[54] CURL-RESISTANT PRINTING SHEET FOR LABELS AND TAGS

[75] Inventors: Peter J. Dronzek, Jr., 6 Poe Rd., Thornwood, N.Y. 10594; Roger H. Sedran, Franklin Lakes, N.J.; Brian K. Burke, Sydney, Australia

[73] Assignee: Peter J. Dronzek, Jr., Thornwood, N.Y.

[21] Appl. No.: 774,415

[22] Filed: Oct. 10, 1991

[51] Int. Cl.[6] ..... G09F 3/00; B42D 15/00

[52] U.S. Cl. ..... 428/40; 428/202; 428/206; 428/922; 428/481; 428/483; 428/425.1; 428/425.6; 428/331; 428/325; 428/513; 428/520; 428/537.5; 428/42; 428/408; 40/638; 283/81

[58] Field of Search ..... 428/40, 42, 202, 206, 428/922, 481, 483, 424.8, 425.6, 408, 425.1, 331, 325, 537.5, 513, 520

[56] References Cited

U.S. PATENT DOCUMENTS

| | | | |
|---|---|---|---|
| 4,494,129 | 1/1985 | Gretchev . | |
| 4,913,926 | 4/1990 | Rutkowski . | |
| 5,019,436 | 5/1991 | Schramer et al. | 428/40 |
| 5,021,110 | 6/1991 | Kobayashi | 428/40 |

FOREIGN PATENT DOCUMENTS

| | | |
|---|---|---|
| 149970 | 2/1984 | Japan . |
| 155675 | 11/1989 | Japan . |

*Primary Examiner*—P. C. Sluby

*Attorney, Agent, or Firm*—Hedman, Gibson & Costigan

[57] ABSTRACT

Composite pressure sensitive label sheets will print in hot laser printers without curling if they comprise at least three layers: A. at least one base layer having a pressure sensitive adhesive on the bottom face, B. a printable surface layer on top of the base layer or layers, and C. a strippable protective backing on the pressure sensitive adhesive coated bottom face on the base layer or layers and if the thermal expansion or contraction characteristics of the printable layer B and the protective backing C are the same or substantially the same.

21 Claims, 1 Drawing Sheet

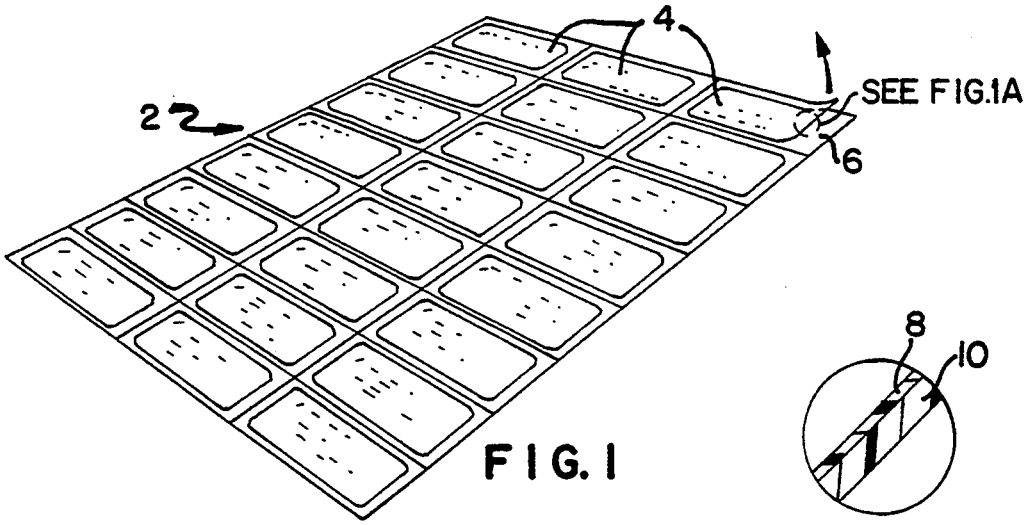
FIG. 1
FIG.1A
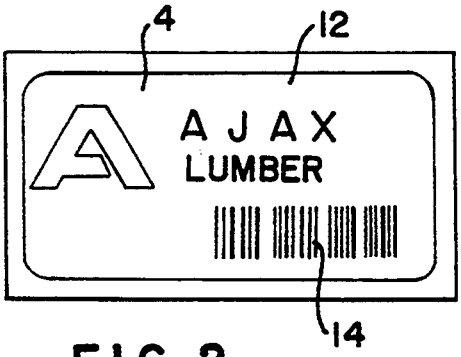
FIG. 2
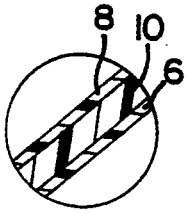
FIG. 3A
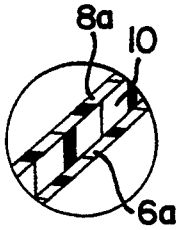
FIG.4A
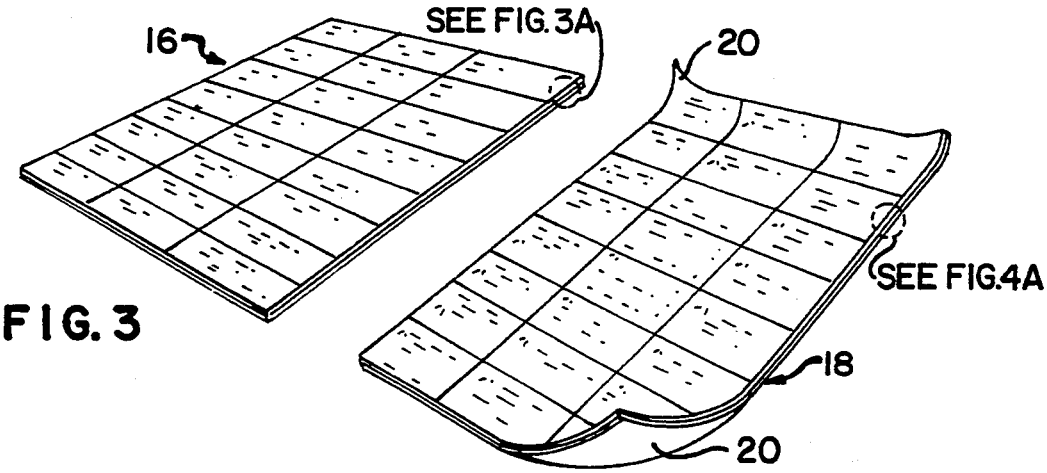
FIG. 3
FIG. 4
PRIOR ART

CURL-RESISTANT PRINTING SHEET FOR LABELS AND TAGS

FIELD OF THE INVENTION

This invention relates to laser and thermally transfer printable multiple layer sheets, such as sheets of dual layer labels or tags which may have pressure sensitive adhesive thereon mounted on backing sheets or films.

BACKGROUND OF THE INVENTION

Laser printing of label materials is a relatively new development and employs apparatus such as shown and described in Gretchev, U.S. Pat. No. 4,494,129. The high pressures and temperatures employed in laser printing can be accommodated by simple, non-composite paper and synthetic sheets. They will not curl and become difficult to feed and stack. If, however, dual-layer and multi-layer composite sheets, which are necessary components of label or tag sheets, are fed to laser printers, special methods are needed to prevent the composite sheets from curling during and after printing. In one such method, Rutkowski, U.S. Pat. No. 4,913,926, discloses laser printing a dual-layer label sheet having a continuous film of pressure sensitive adhesive between the layers. The resultant sheet is shown to be curled up after passing through the printer. If, however, the adhesive is patterned into geometric figures, such as hexagons and diamonds, during deposition to leave a number of gaps between the patterns, and then the sheets are laser printed, no curling is observed because the melted and squeezed adhesive layer flows into and fills the gaps relieving any stresses developed by heat and pressure. In the method of Rutkowski, special equipment will be necessary for patterned printing and the high degree quality control necessary should be labor intensive. Another approach to providing adhesive paper labels having curling resistance and applicable to electrostatic and magnetic copying in disclosed by Fuji Xerox Corp in Japanese Patent Publication No. J59149970-A, Aug. 28, 1984. Such a composite comprises two sheets, a surface paper to receive the printing and a release paper having a ratio of surface paper to release paper elongation and/or contraction of 0.7–1.0:1.0. Furthermore, the release paper has an elongation and/or contraction of below 0.90%. If such a composite is used to make laser printed labels comprising wood pulp paper, curling is distinctly not a problem, but the labels do not weather well and cannot be used outdoors, such as to mark lumber, because rain, wind and snow will make them difficult to read and maintain. If, on the other hand, such labels are made of synthetic paper, such as polyvinyl chloride paper, curling is not a problem because the elongation/contraction requirements are met, but the vinyl paper, like wood pulp paper, doesn't weather well and tears readily during application, and has a tendency to give off dangerous gases if burned. Improved weatherability, equivalent printability, high tear resistance and no tendency to elaborate noxious gases during heating can be achieved, if instead of vinyl, tear-resistant synthetic papers are used, such as those based on thermoplastic polyesters and polyolefins, e.g., polypropylene, and the like. However, the substitution of these for wood pulp paper and vinyl paper in the composite dual-layer label sheets of the Rutkowski and the Japanese Publication, above-mentioned, lead to serious and substantial curling problems during and after laser printing.

It has now been discovered that if a composite label sheet is provided having at least three layers and if, further, the top and bottom layers are selected to have the same or substantially the same thermal expansion and contraction characteristics, then non-vinyl, tear-resistant plastic papers such as polyester and polyolefins and the like can be used to provide non-curling label sheets, with none of the above-mentioned disadvantages of wood pulp paper and vinyl composite sheets and labels. This result is unexpected in view of the art because the base layer of this invention can have an expansion/contraction ratio substantially different than either the printable top layer and the protective backing layer or coating, whereas the Japanese Patent Publication would teach otherwise.

Accordingly, a principal object of the present invention is to provide laser printable sheets of labels or tags mounted on backing sheets without the curling problem discussed above. It is a further object of the invention to provide a method for laser printing sheets of labels mounted on protective backing without curling. It is still another object of the invention to provide articles labeled with curl-free laser printed labels or tagged with curl free laser printed tags.

These and other objects of the invention will become apparent from the present specification and drawing.

SUMMARY OF THE INVENTION

According to this invention, in one of its major aspects, there are provided durable composite sheets for labels or tags which do not curl when heated to temperatures normally encountered in laser or thermal transfer printing, the label sheets including at least three layers comprised of:

A. at least one base layer comprising a paper or a synthetic paper or a coated film;

B. at least one print receiving layer comprising a paper or a synthetic paper or a coated film adhered to the top face of base layer or layers A; and C. at least one backing layer comprising a paper or a synthetic paper or a coated film adhered to the bottom face of base layer or layers A, the top layer B and the backing C having the same or substantially the same thermal elongation or contraction characteristics.

Special mention is made of a preferred aspect of the invention which comprises a composite pressure sensitive label sheet which does not curl when heated to temperatures normally encountered in laser printing, said label sheet including at least three layers comprised of:

A. at least one base layer comprising a tear resistant synthetic paper having a pressure sensitive adhesive on the bottom face thereof;

B. a print receiving tear resistant synthetic paper layer permanently adhered to the top face of base layer or layers A; and C. a protective backing comprising a paper layer or a coated film releasably adhered to said pressure sensitive adhesive on the bottom face of base layer or layers A, said top layer B and said protective backing C having the same or substantially the same thermal elongation or contraction characteristics.

In preferred features, the invention contemplates label or tag sheets as defined above wherein layers A and B comprise all or subdivided portions thereof; those, wherein layer A comprises a thermoplastic polyester, and layer B and protective backing C comprise a polyolefin; and such sheets wherein layer A comprises a thermoplastic polyester, layer B comprises a polyolefin and backing C comprises a thermoplastic resin coating. Also contemplated are sheets as defined above which also include a laser printing enhancing coating on the print receiving face of layer B, especially those wherein the printing enhancing coating comprises an acrylic, polyester or urethane resin filled with finely divided clay or silica; those wherein layer B is adhered to layer or layers A through an adhesive layer having high cohesive strength and low shear strength whereby layers B and A can move transversely under the influence of heat without parting. Further preferred embodiments comprise label sheets as defined above wherein backing C can be releasably adhered to the pressure sensitive adhesive on base layer or layers A through a release coating, especially those wherein the release coating comprises a silicone and the pressure sensitive adhesive layer has high cohesion and low shear strength whereby layers C and A can move transversely under the influence of heat without parting. In addition, the invention includes label or tag sheets as defined above wherein layer or layers A include an effective amount of conductive filler for dissipating static changes developed during laser printing whereby sheet feeding and delivery problems are minimized, special mention being made of such sheets wherein the conductive filler comprises carbon black. Best results appear to be obtained with label or tag sheets as defined above wherein layer B has a ratio of thermal elongation or contraction in the range of from about 0.7 to about 1.3 with respect to 1.0 for protective backing C, especially those wherein said layer B has a ratio or thermal elongation or contraction of about 1.0 with respect to 1.0 for protective backing C.

In another major aspect, the invention provides a method for preparing curl-free laser printed sheets of labels or tags, comprising the steps of:

(1) providing composite sheets including at least three layers comprised of:

A. at least one base layer comprising a tear resistant synthetic paper having a pressure sensitive or laminating adhesive on the bottom face thereof;

B. a print receiving tear resistant synthetic paper layer permanently or releasably adhered to the top face of base layer or layers A; and C. a backing comprising a paper layer or a coated film adhered to the pressure sensitive or laminating adhesive on the bottom face of base layer or layers A, the top layer B and the backing C having the same or substantially the same thermal elongation or contraction characteristics;

(2) printing onto the composite sheets in a laser printer; and (3) applying substantial temperature and pressure to the sheet in the course of said printing operation, e.g., between a heated output pressure roller and an electrostatically chargeable drum employed in applying toner to the sheets.

Still another major aspect of the invention provides curl-free laser printed label or tag sheets including at least three layers comprised of:

A. at least one base layer comprising a tear resistant synthetic paper having a pressure sensitive or laminating adhesive on the bottom face thereof;

B. A laser printed tear resistant synthetic paper layer permanently or releasably adhered to the top face of base layer or layers A; and C. a backing comprising a paper layer or a coated film permanently or releasably adhered to the pressure sensitive or laminating adhesive on the bottom face of base layer or layers A, the top layer B and said backing C having the same or substantially the same thermal elongation or contraction characteristics. Among the embodiments of the invention are articles labeled with a curl-free laser printed label as defined immediately above by the steps of releasing the backing C or layers A and C and affixing the pressure sensitive adhesive on the bottom face of layer or layers A or B to said article.

DESCRIPTION OF THE DRAWING

FIG. 1 is a perspective view of a three-layer sheet of printed labels mounted on a backing sheet, a section of the edge being enlarged in FIG. 1A to show detail;

FIG. 2 is a top view of one of the labels from the sheet shown in FIG. 1;

FIG. 3 shows a three-layer sheet having balanced thermal expansion/contraction characteristics in accordance with the invention following printing through a laser printer, a section of the edge being enlarged in FIG. 3A to show detail; and FIG. 4 shows a three-layer sheet having unbalanced thermal expansion/contraction characteristics not in accordance with this invention, which has been curled up as a result of being printed in a laser printer, a section of the edge being enlarged in FIG. 4A to show detail.

DETAILED DESCRIPTION OF THE INVENTION

Referring more particularly to the drawings, FIG. 1 shows a three-layer sheet 2 including an upper sheet made up of a large number of labels 4 which have been die cut to be separate from one another and which are mounted on backing sheet 6. As will be seen from FIG. 1A., each label comprises printable surface layer 8 alone or on top of base layer 10.

FIG. 2 is a front view of one of the labels 4 which has been removed from the backing sheet 6. More specifically, on the front of the label 4 as shown in FIG. 2, is some printing or advertising 12, and a bar code configuration 14.

On the back of label 4 is a continuous layer of pressure sensitive adhesive (not shown) of an entirely conventional type well known to those skilled in the art. There is no need whatsoever to pattern the layer of adhesive into geometric forms as is done in some of the commercial labels in the current state of the art.

FIGS. 3 and 3A show a three-layer label sheet 16 of the present invention, comprising a top sheet 8 and protective backing 6 having the same thermal expansion/contraction characteristics, in which the label sheet 16, following printing, is entirely level and flat. In FIGS. 4 and 4A, however, it is shown that a three-layer sheet 18 comprising a top sheet **8*a* and protective backing 6*a* having substantially different and unbalanced thermal expansion/contraction characteristics on either side of base layer 10, and, following printing in a laser printer, it curls up as indicated, particularly at corners 20**. This curling is found to be so significant that proper stacking of the printed sheet labels is not practical, nor is further mechanical processing of the sheets.

To save unnecessarily detailed description, laser printing apparatus, which are well known, are incorporated by reference to U.S. Pat. Nos. 4,494,129 and 4,913,926, mentioned hereinabove. In general, all such apparatus use electrostatically chargeable drums to form an image and heated rollers to apply moderately high levels of pressure, e.g., greater than about 100 pounds per square inch, and elevated temperatures, e.g., greater than about 250° F., to the sheets during the printing process. It is believed that these relatively high pressures and temperatures produce the curled adhesively bonded label sheets as shown in FIG. 4 when no particular attention is paid to selecting top and bottom layers 8*a* and 6*a* so that they have the same or substantially the same thermal expansion/contraction characteristics as is required by the present invention.

However, by using a balanced composite as shown in FIG. 3A of the drawing, wherein layers 8 and 6 have the same or substantially the same thermal expansion/-contraction characteristics the tension or strain produced between the heated roller or rollers and the drum will be compensated for and printing will be accomplished while still producing flat output label sheets.

Suitable materials from the paper sheets comprise thermoplastic polyester, e.g., poly(ethylene terephthalate), poly(acrylonitrile), and the like, as well as polyolefins, such as polypropylene, polyethylene, and the like. For the base layer or layers, polyesters are preferred, and especially poly(ethylene terephthalate) which is available from a number of sources. For the top layer, monoaxially or biaxially oriented polyolefins are preferred, especially polypropylene, and such papers are available from a number of sources, such as Mobil Chemical Company, Pittsford, N.Y. 14534, U.S.A., tradename "Oppalyte" TW and Toray Plastics, Inc., North Kingston, R.I., 02852, U.S.A., tradenames "Treafilms" and "Treax Films".

Thermal elongation and/or contraction characteristics are measured by standard test methods. The values are used to select suitable substrates for use in this invention. It is important that the relative values rather than their magnitude receive the most attention. It is known for example that polypropylene paper has a shrinkage at 275° F. of −4.5% in the MD and −5.0% in the TD. If a composite is prepared having polypropylene on the top and the bottom and poly(ethylene terephthalate) in the center, curl-free laser printing will be achieved because the top and bottom layers will have the same thermal contraction. If, however, a dual layer composite or polypropylene on top of polyester or a three layer comprising polypropylene (top), polyester(-middle) and polyester (bottom) is prepared, the composites are unbalanced, as explained above, and they will not print without curling.

The layers can be simply heat-bonded with heat-activated adhesive, but it is preferred to use an adhesive of a permanent type and of a pressure sensitive type. Many adhesives are suitable although it is preferred to select one which has a high cohesive strength and low shear strength to facilitate transverse movement between different layers during heating while precluding parting.

In preferred embodiments, the backing C or layer A will be adhered to the pressure sensitive adhesive through a release coating, such as a poly(tetrafluoroethylene film) or more preferably a silicone resin, as is known in the art, for the labels. Layers B and C may be permanently adhered to layer A by a laminating adhesive for the tags. A release coating is not needed for the tags.

Among the preferred features of the invention are label sheets of the type described wherein the base layer is rendered electrically conductive by including an effective amount of a conductive filler, e.g., a powder such as silver and nickel powders or carbon powders. Conductive fillers can also be put in adhesives instead of base layers and also in printable coatings, without departing from the spirit or scope of the invention. The poly(ethylene terephalate) base layer, and/or the other substrates, can for example include 5 to 40 percent by weight of carbon powder, and not only will the sheets not curl during printing, but they also will dissipate static changes developed during printing which can also interfere with feeding, imaging and delivery. For best results, when using polyolefin layers, composite volume resistivity gives best printing at values equal to or less than $10^{14}$ ohms-cm.

Concerning the backing, this can be the same or different in terms of material from the top layer so long as the expansion/contraction characteristics are the same or substantially the same, preferably from 0.7–1.3:1 and more preferably 1:1. The backing can even comprise a film coating instead of a sheet, and the backing can even comprise a wood pulp paper sheet, such as a silicone-coated paper sheet, instead of a synthetic paper sheet, without departing from the scope of the invention.

The composites are assembled in conventional ways using conventional equipment. The sheets are consolidated continuously under moderate heat and pressure and cut to any desired size and, if desired, the labels or tags are die-cut into the sheets by means well known to those skilled in this art.

The patents, applications, publications and test methods mentioned above are incorporated herein by reference.

Many variations of the present invention will suggest themselves to those skilled in the art in light of the above detailed description and accompanying drawing. For example, instead of oriented polypropylene as the face film, poly(ethylene terephthalate), cellulose acetate, polyethylene, polycarbonate, fluoropolymers and polyimide films can be used. Instead of polypropylene as the release film, silicone coated paper can be used. A laser or thermal transfer printing enhancing coating such as an acrylic or polyester or urethane resin containing finely divided clay or silica, can be spread on the print receiving face of the top sheet. All such obvious modifications are within the full intended scope of the appended claims.

We claim:

1. A durable sheet adapted for use as a label which does not curl when heated to temperatures normally encountered in laser or thermal transfer printing, the sheet including at least three layers layer A, which consists essentially of at least one base layer consisting of a paper, a synthetic paper or a coated film;

layer B, which consists essentially of at least one print receiving layer consisting of a paper, a synthetic paper or a coated film, wherein layer B is adhered to the top face of layer A; and layer C, which consists essentially of at least one backing layer consisting of a paper, a synthetic paper or a coated film, wherein layer C is adhered to the bottom face of layer A; and wherein layer B and layer C have the same or substantially the same thermal elongation or contraction characteristics; and wherein the top surface of layer A comprises a release agent, the bottom surface of layer B comprises a pressure sensitive adhesive and layer C is permanently adhered to layer A.

2. A durable sheet adapted for use as a label which does not curl when heated to temperatures normally encountered in laser or thermal transfer printing, the sheet including at least three layers comprised of:

layer A, which consists essentially of at least one base layer consisting of comprising a paper, a synthetic paper or a coated film;

layer B, which consists essentially of at least one print receiving layer consisting of a paper, a synthetic paper or a coated film, wherein layer B is adhered to the top face of layer A; and layer C, which consists essentially of at least one backing layer consisting of a paper, a synthetic paper or a coated film, wherein layer C is adhered to the bottom face of layer A; and wherein layer B and layer C have the same or substantially the same thermal elongation or contraction characteristics; and wherein the top surface of layer C comprises a release agent, the bottom surface of layer A comprises a pressure sensitive adhesive and layer B is permanently adhered to layer A.

3. A durable sheet for labels or tags which does not curl when heated to temperatures normally encountered in laser or thermal transfer printing, the sheet including at least three layers comprised of:

layer A, which consists essentially of at least one base layer consisting of comprising a paper, a synthetic paper or a coated film;

layer B, which consists essentially of at least one print receiving layer consisting of a paper, a synthetic paper or a coated film, wherein layer B is adhered to the top face of layer A; and layer C, which consists essentially of at least one backing layer consisting of a paper, a synthetic paper or a coated film, wherein layer C is adhered to the bottom face of layer A, and wherein layer B and layer C have the same or substantially the same thermal elongation or contraction characteristics; and wherein layer A comprises a thermoplastic resin, and layer B and layer C comprise a polyolefin.

4. A durable sheet for labels or tags which does not curl when heated to temperatures normally encountered in laser or thermal transfer printing, the sheet including at least three layers comprised of:

layer A, which consists essentially of at least one base layer consisting of comprising a paper, a synthetic paper or a coated film;

layer B, which consists essentially of at least one print receiving layer consisting of a paper, a synthetic paper or a coated film, wherein layer B is adhered to the top face of layer A; and layer C, which consists essentially of at least one backing layer consisting of a paper, a synthetic paper or a coated film, wherein layer C is adhered to the bottom face of layer A, and wherein layer B and layer C have the same or substantially the same thermal elongation or contraction characteristics; and wherein layer A comprises a thermoplastic polyester, layer B comprises a polyolefin and layer C comprises a thermoplastic resin coating.

5. A durable sheet for labels or tags which does not curl when heated to temperatures normally encountered in laser or thermal transfer printing, the sheet including at least three layers comprised of:

layer A, which consists essentially of at least one base layer consisting of comprising a paper, a synthetic paper or a coated film;

layer B, which consists essentially of at least one print receiving layer consisting of a paper, a synthetic paper or a coated film, wherein layer B is adhered to the top face of layer A; and layer C, which consists essentially of at least one backing layer consisting of a paper, a synthetic paper or a coated film, wherein layer C is adhered to the bottom face of layer A, and wherein layer B and layer C have the same or substantially the same thermal elongation or contraction characteristics; and which also includes a laser printing enhancing coating on the print receiving face of layer B.

6. A sheet as defined in claim 5 wherein said printing enhancing coating comprises an acrylic, polyester or urethane resin filled with finely divided clay or silica.

7. A sheet as defined in claim 5 wherein layer A includes an effective amount of conductive filler for dissipating static changes developed during laser printing whereby sheet feeding and delivery problems are minimized.

8. A sheet as defined in claim 7 wherein said conductive filler comprises carbon black.

9. A sheet as defined in claim 5 wherein layer B has a ratio of thermal elongation or contraction in the range of from about 0.7 to about 1.3 with respect to 1.0 for layer C.

10. A label sheet as defined in claim 9 wherein said layer B has a ratio or thermal elongation or contraction of about 1.0 with respect to 1.0 for layer C.

11. A composite pressure sensitive label sheet which does not curl when heated to temperatures normally encountered in laser printing, said label sheet including at least three layers comprised of:

layer A, which consists essentially of at least one base layer consisting of a tear resistant synthetic paper having a pressure sensitive adhesive on the bottom face thereof;

layer B, which consists essentially of a print receiving tear resistant synthetic paper layer permanently adhered to the top face of layer A; and layer C, which consists essentially of a protective backing consisting of a paper layer or coated film releasably adhered to said pressure sensitive adhesive on the bottom face of layer A, said layer B and said layer C having the same or substantially the same thermal elongation or contraction characteristics.

12. A label sheet as defined in claim 11 wherein layers A and B are a single label.

13. A label sheet as defined in claim 11 wherein layer A comprises a thermoplastic polyester, and layer B and layer C comprise a polyolefin.

14. A label sheet as defined in claim 11 wherein layer A comprises a thermoplastic polyester, layer B comprises a polyolefin and layer C comprises a thermoplastic resin coating.

15. A label sheet as defined in claim 11 which also includes a laser printing enhancing coating on the print receiving face of layer B.

16. A label sheet as defined in claim 15 wherein said printing enhancing coating Comprises an acrylic, polyester or urethane resin filled with finely divided clay or silica.

17. A label sheet as defined in claim 11 wherein layer B is permanently adhered to layer A, with an adhesive layer which has high cohesive strength and low shear strength, whereby said layers A and B can move transversely under the influence of heat without parting.

18. A label sheet as defined in claim 11 wherein layer C is releasably adhered to the pressure sensitive adhesive on layer A with a release coating.

19. A label sheet as defined in claim 18 wherein said release coating comprises a silicone and said pressure sensitive adhesive layer has high cohesion and low shear strength whereby said layers C and A can move transversely under the influence of heat without parting.

20. A label sheet as defined in claim 11 wherein layers A and B are subdivided into a plurality of labels of substantially the same size.

21. A curl-free laser printed label sheet including at least three layers comprised of:

layer A, which consists essentially of at least one base layer consisting of a tear resistant synthetic paper having a pressure sensitive adhesive on the bottom face thereof;

layer B, which consists essentially of a laser printed tear resistant synthetic paper layer permanently adhered to the top face of layer A; and layer C, which consists essentially of a protective backing consisting of a paper layer or a coated film releasably adhered to said pressure sensitive adhesive on the bottom face of layer A, said layer B and said layer C having the same or substantially the same thermal elongation or contraction characteristics.

* * * * *

UNITED STATES PATENT AND TRADEMARK OFFICE

CERTIFICATE OF CORRECTION

PATENT NO : 5,418,026
DATED : May 23, 1995
INVENTOR(S) : Peter J. Dronzek, Jr., Roger H. Sedran and Brian K. Burke It is certified that error appears in the above-identified patent and that said Letters Patent is hereby corrected as shown below:

Column 7, lines 10, 32, 53; and Column 8, line 6 (each occurrence), cancel "comprising".

Signed and Sealed this

Thirtieth Day of March, 1999

*Attest:*

*Attesting Officer*

Q. TODD DICKINSON

*Acting Commissioner of Patents and Trademarks*